US005855191A

United States Patent [19]

Blowers et al.

[11] Patent Number: 5,855,191

[45] Date of Patent: Jan. 5, 1999

[54] METERING VALVE FOR BALL PLUNGER OR PUSHROD SOCKET

[75] Inventors: Bryan K. Blowers, Battle Creek; George A. Hillebrand, Hickory Corners; Brian W. Carpenter, Battle Creek, all of Mich.

[73] Assignee: Eaton Corporation, Cleveland, Ohio

[21] Appl. No.: 880,417

[22] Filed: Jun. 23, 1997

[51] Int. Cl.[6] ..... F01L 1/16; F01L 1/24; F01L 9/10

[52] U.S. Cl. ..... 123/90.36; 123/90.43; 123/90.49; 123/90.55; 123/90.35

[58] Field of Search ..... 123/90.33, 90.35, 123/90.36, 90.43, 90.46, 90.48, 90.49, 90.52, 90.55, 90.57

[56] References Cited

U.S. PATENT DOCUMENTS

| | | | |
|---|---|---|---|
| 3,587,539 | 6/1971 | Dadd | 123/90.43 |
| 4,004,558 | 1/1977 | Scheibe | 123/90.35 |
| 4,184,464 | 1/1980 | Svihlik | 123/90.55 |
| 5,622,147 | 4/1997 | Edelmayer | 123/90.35 |

FOREIGN PATENT DOCUMENTS 195 07 240 9/1996 Germany .

*Primary Examiner*—Weilun Lo
*Attorney, Agent, or Firm*—L. J. Kasper

[57] ABSTRACT

A hydraulic lash adjuster of the type including a ball plunger (61) defining a passage (63), or a body portion (85) defining a passage (87). A metering valve is disposed in the passage, and in accordance with the invention (FIGS. 2–4), a shank portion (77) of the metering pin (73) defines a metering passage (81). During normal operation, pressure in the low pressure chamber (21) biases the metering pin (73) upward, to a position in which fluid can flow from the chamber (21), through the metering passage (81), to the external surface (71) of the ball plunger (61). When pressure in the chamber (21) is very low, or negative, a head portion (75) is disposed against a seat (69) in the manner of a check valve. The up and down movement of the pin (73) prevents the metering passage (81) from becoming plugged with contaminants.

7 Claims, 3 Drawing Sheets

METERING VALVE FOR BALL PLUNGER OR PUSHROD SOCKET

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to hydraulic lash adjusters, and more particularly, to such lash adjusters which define internal fluid reservoirs, and which operate in engagement with the surface of another member such as a rocker arm, or a pushtube, wherein the area of engagement between the lash adjuster and the other member requires lubrication.

Hydraulic lash adjusters (also sometimes referred to as "lifters") for internal combustion engines have been in use for many years, to eliminate clearance (or lash) between engine valve train components under varying operating conditions, in order to maintain efficiency and to reduce noise and wear in the valve train. A hydraulic lash adjuster (HLA) operates on the principle of transmitting the energy of the valve actuating cam through hydraulic fluid, trapped in a pressure chamber under a plunger. During each operation of the cam, as the length of the valve actuating components varies as a result of temperature changes and wear, small quantities of hydraulic fluid are permitted to enter the pressure chamber, or escape therefrom, thus effecting an adjustment in the position of the plunger, and consequently adjusting the effective total length of the valve train.

In a typical, prior art HLA, there is a body defining a bore and a plunger assembly disposed within the bore to define a pressure chamber. The plunger defines a low pressure chamber (or reservoir) which receives fluid from an external source, such as an oil passage in the cylinder head. The plunger also includes either a "ball plunger" portion, or a "pushrod socket" portion which, by way of example only, engages a mating surface of a rocker arm or a pushtube, respectively. In a Type V valve gear, the pushrod socket moves with the plunger assembly and, therefore, subsequent references hereinafter and in the appended claims to a "ball plunger" will be understood to mean and include the pushrod socket used in the Type V lash adjuster. The engagement of the ball plunger and the rocker arm requires lubrication, and lubrication fluid flows from the reservoir of the HLA, through a metering valve (metering pin) to the external surface of the ball plunger. The metering valve must be able to meter or control the flow of fluid from the reservoir, and at the same time, prevent air from entering the reservoir through the metering orifice whenever the fluid pressure in the reservoir drops. It is because of this later requirement that a simple orifice in the ball plunger is not acceptable.

An attempt of those skilled in the prior art to meet the requirements set forth above is illustrated and described in U.S. Pat. No. 4,004,558 in which the metering orifice is defined by a diametral clearance between a bore in the ball plunger and the metering pin. However, the metering orifice is typically quite small, and as is well known to those skilled in the art, maintaining accurate control of an area which is a diametral clearance is quite difficult.

German Patent DE 19507240 illustrates another attempted solution in which the ball plunger defines a bore receiving a rivet. The rivet shank defines an axial groove which would appear functionally capable of serving as the metering orifice. However, the rivet is fixed within the bore and would likely become plugged up with dirt and other contaminants, thus preventing the necessary flow of lubrication fluid.

BRIEF SUMMARY OF THE INVENTION

Accordingly, it is an object of the present invention to provide an improved metering pin arrangement for the ball plunger of an hydraulic lash adjuster which makes it possible to achieve better control over the flow of lubrication fluid from the fluid reservoir to the adjacent surface of the rocker arm or pushtube.

It is a related object of the invention to provide an improved metering pin arrangement, which accomplishes the above-identified object, and in addition involves relative movement of the parts, to achieve a self-cleaning of the metering orifice.

The above and other objects of the invention are accomplished by the provision of an hydraulic lash adjuster for an internal combustion engine, the lash adjuster comprising a body defining a bore formed therein. A plunger assembly is slidingly received within the bore and cooperates therewith to define a pressure chamber. A fluid chamber is disposed within the plunger assembly and is in communication with a source of fluid. One of the body and the plunger assembly includes an external surface adapted for engagement with another member, and the one of the body and the plunger assembly defines an axially extending opening extending from the fluid chamber to the external surface. A metering pin is disposed in the opening, and is axially moveable therein.

The improved lash adjuster is characterized by the metering pin in the opening cooperating to define means limiting downward movement of the pin member toward the fluid chamber, and operable to prevent fluid flow from outside the lash adjuster, past the metering pin and into the fluid chamber. The metering pin includes a stop portion larger than the axially extending opening, to limit upward movement of the metering pin in response to pressure in the fluid chamber. The axially extending opening and the metering pin cooperate to define a metering passage having a predetermined metering flow area when the metering pin is in its upward most axial position, to permit communication of fluid from the fluid chamber to the external surface.

DETAILED DESCRIPTION OF THE PREFERRED EMBODIMENT

Figure 1:
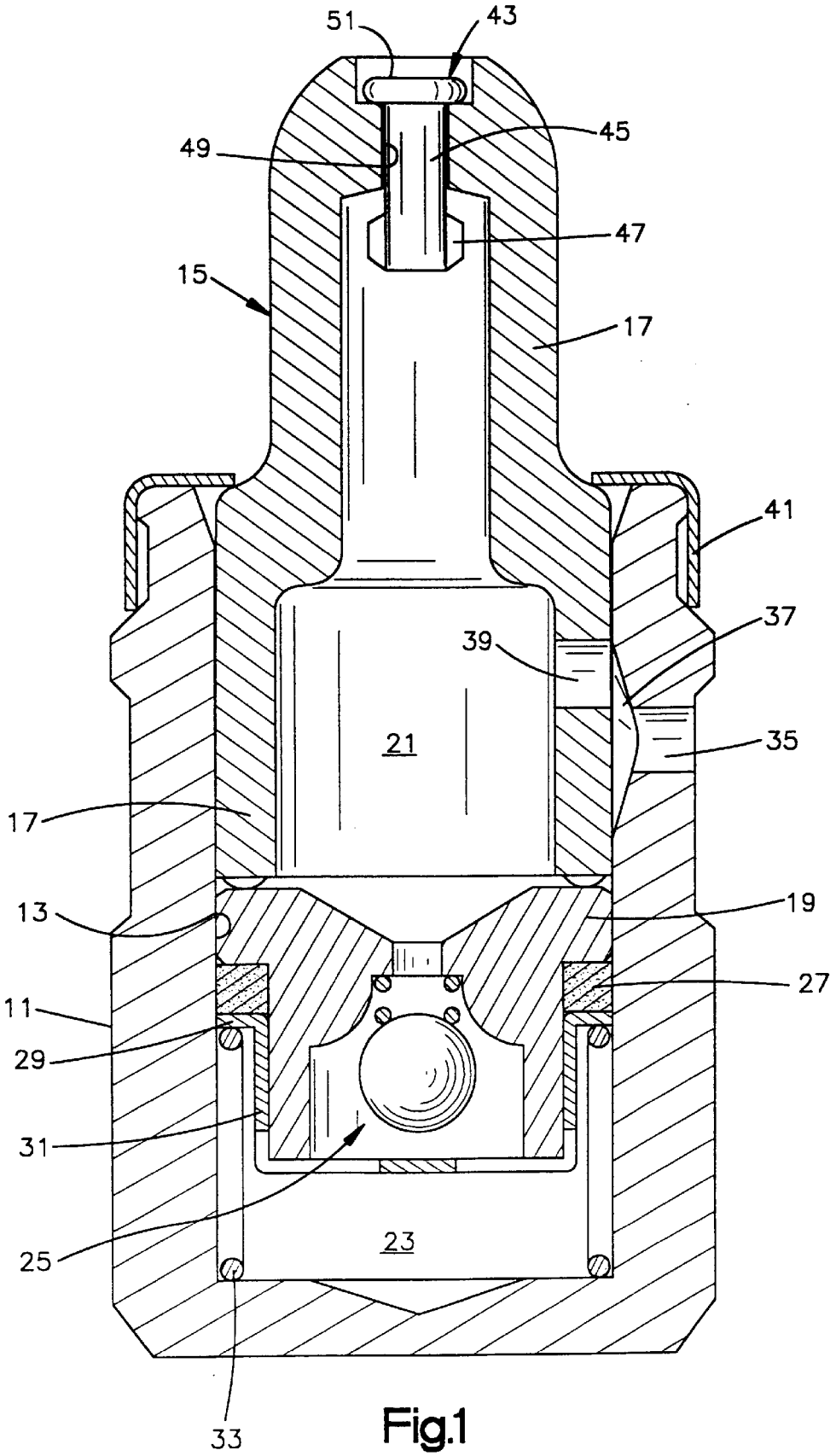
Fig.1 PRIOR ART
FIG. 1 is an axial cross-section of an hydraulic lash adjuster of the type which may utilize the present invention, but which is shown including the "PRIOR ART" metering pin.

Referring now to the drawings, which are not intended to limit the invention, FIG. 1 illustrates a hydraulic lash adjuster (HLA) of the general type illustrated and described in U.S. Pat. No. 5,622,147, for a "HYDRAULIC LASH ADJUSTER", and in application U.S. Ser. No. 792,809, filed Jan. 30, 1997, now U.S. Pat. No. 5,758,613, in the names of Thomas C. Edelmayer, George A. Hillebrand, and Robert G. Paulson, Jr., for a "HYDRAULIC LASH ADJUSTER AND BIASED NORMALLY OPEN CHECK VALVE SYSTEM THEREFOR", both of which are assigned to the assignee of the present invention and incorporated herein by reference. However, those skilled in the art will understand that the present invention is not limited to the particular type of HLA shown in the above-incorporated applications.

The lash adjuster of the present invention comprises a body 11 defining a blind bore 13. A plunger assembly, generally designated 15, is slidably disposed within the blind bore 13, and includes an upper plunger element 17, and a lower plunger element 19. The plunger elements 17 and 19 cooperate to define a low pressure chamber 21 (also referred to hereinafter as the "reservoir"). The blind bore 13 and the plunger assembly 15 cooperate to define a high pressure chamber 23 (also referred to hereinafter as simply the "pressure chamber"). A check valve assembly, generally designated 25, is operable to permit fluid communication between the reservoir 21 and the pressure chamber 23.

Disposed between the lower plunger element 19 and the bore 13 is a dynamic seal member 27, against which is seated a flange 29 extending radially outwardly from a generally cup-shaped retainer 31. Although the subject embodiment is of the sealed reservoir type, it should be understood that the present invention can also be used advantageously in conventional "leakdown" type lash adjusters. Preferably, there is an interference fit between the retainer 31 and the reduced diameter portion of the lower plunger element 19. The plunger assembly 15 and the retainer 31 are maintained in the position shown by means of a plunger spring 33.

In the subject embodiment, hydraulic fluid is supplied to the low pressure chamber 21 through a port 35 which opens into the bore 13, and intersects a collector groove 37. The groove 37 also intersects a port 39 defined by the upper plunger element 17, and opening into the low pressure chamber 21. A cap member 41 retains the plunger assembly 15 in a manner well known to those skilled in the art. Metered hydraulic fluid is supplied to the engine rocker arm R (see FIG. 2) by means of a valve assembly, generally designated 43, which allows a limited flow of fluid outward from the plunger assembly 15, but which also acts as a check valve to prevent the inflow of air in the event of a very low pressure or negative pressure condition within the chamber 21. The PRIOR ART valve assembly 43 is illustrated in FIG. 1 as including a pin 45 having outwardly extending portions 47 which can be compressed to snap the pin 45 into place through a port 49 formed in the end of the upper plunger element 17. Preferably, a head 51 is formed on the upper end of the pin 45, and is operable to seat against an adjacent surface and serve as the check valve.

Although the embodiment illustrated in FIG. 1 is a preferred embodiment of lash adjuster, it will be understood by those skilled in the art that various other means, such as a gravity flow or a self-contained supply, can be provided to supply fluid to the low pressure chamber or reservoir 21, all within the scope of the present invention.

Figure 2:
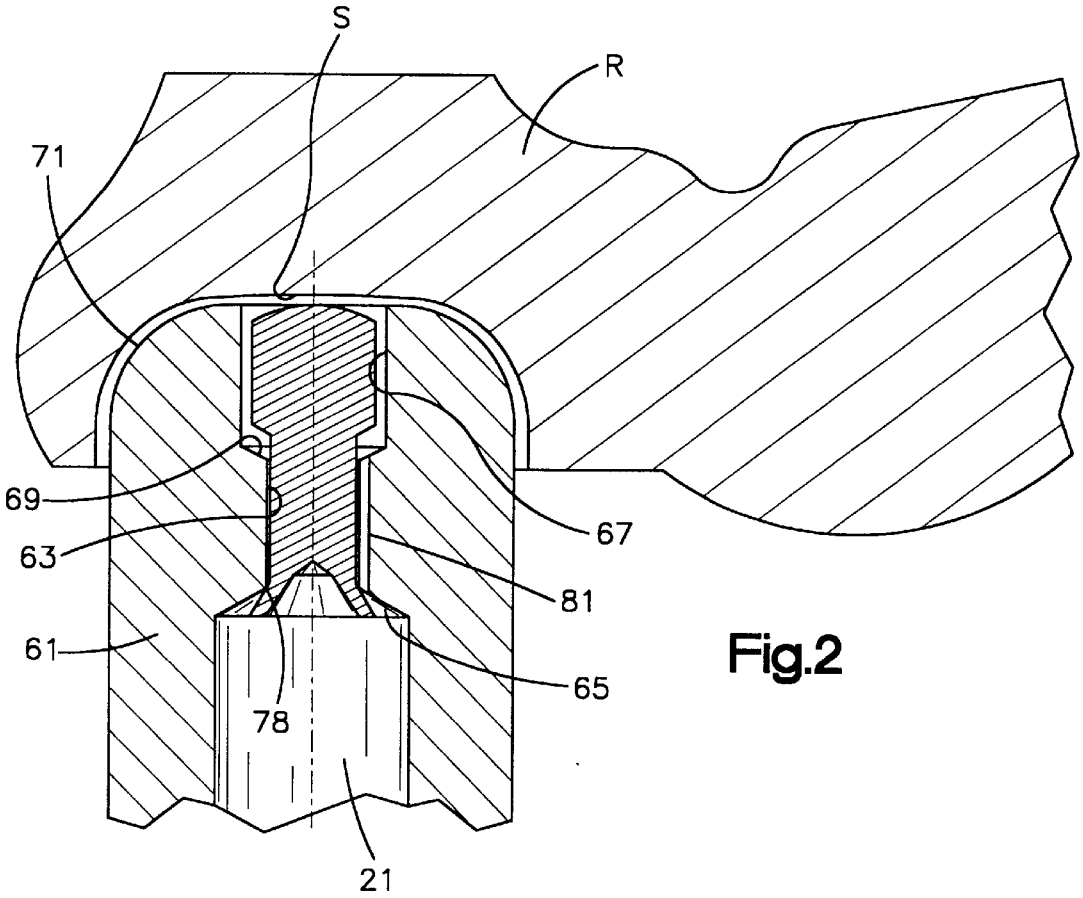
FIG. 2 is an enlarged, fragmentary, axial cross-section of the ball plunger portion of the lash adjuster shown in FIG. 1, including the metering pin of the present invention, in its normal environment engaging a rocker arm.
Figure 3:
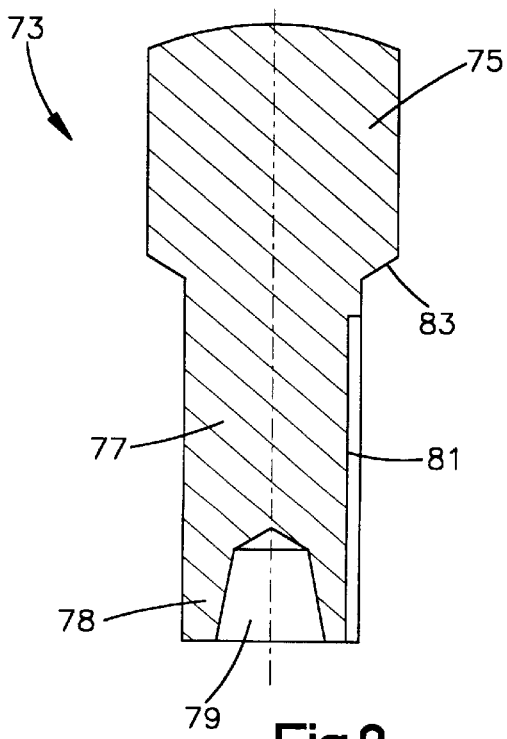
FIG. 3 is a further enlarged, axial cross-section of the metering pin shown in FIG. 2, but taken prior to assembly, and on a different plane than FIG. 2.
Figure 4:
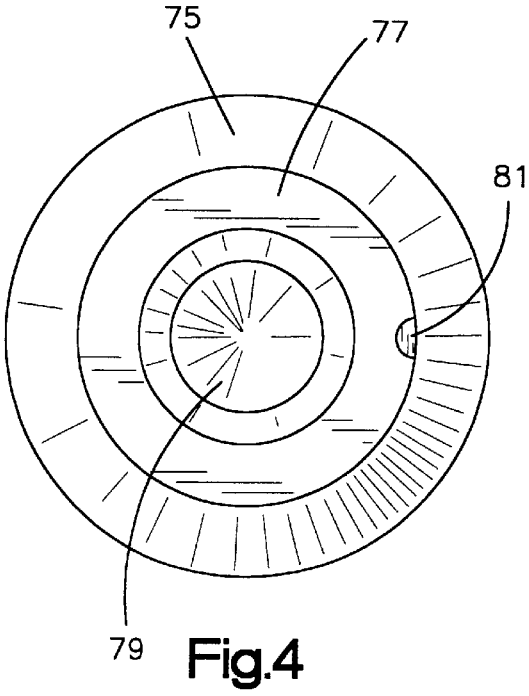
FIG. 4 is a further enlarged bottom end view of the metering pin of the present invention, as shown in FIG. 3.

Referring now primarily to FIGS. 2 through 4, the upper plunger element 17, in accordance with the present invention, includes a ball plunger portion 61, the ball plunger 61 defining an axially extending passage 63. The passage 63 includes a lower frustoconical seat 65. The passage 63 also includes an enlarged upper bore portion 67, the passage 63 and the bore 67 intersecting at a seat 69.

As is well known to those skilled in the art, the arrangement illustrated fragmentarily in FIG. 2 would typically be part of a Type II valve train, in which the lash adjuster, and especially the ball plunger 61, serves as a fulcrum or pivot point for the rocker arm R. Therefore, the rocker arm R defines a generally hemispherical surface S, and the ball plunger 61 defines an external surface 71 which is in constant rubbing engagement with the internal surface S, as the rocker arm pivots about the ball plunger 61. In FIG. 2, for ease of illustration, a substantial radial clearance is indicated between the internal surface S and the external surface 71, but those skilled in the art will understand that there is a relatively close fit, with contact occurring over a relatively large area of the surfaces S and 71.

Disposed within the passage 63 is a metering pin, generally designated 73 (see FIG. 3), which may also be referred to as a "jiggle pin" or as a metering valve. Prior to assembly into the ball plunger 61, the metering pin 73 has the appearance and shape as shown in FIG. 3, including a head portion 75 and a shank portion 77.

In the subsequent description, and in the appended claims, references to directions, such as "upward" and "downward" will be understood to have their normal meanings and will refer to those directions as the drawing figures are normally viewed. However, the directions are indicated merely by way of explanation, recognizing that, for example, the lash adjuster is normally oriented approximately in the orientation shown in FIGS. 1 and 2. Toward the downward end of the shank portion 77 there is a cylindrical opening 79, such that a surrounding lower portion 78 of the shank portion 77 is thin enough in the radial direction to be deformed after assembly into the passage 63. The shank portion 77 defines an axially extending metering passage 81. The passage 81 extends upward along the shank portion 77 almost to the head portion 75, as will be described in greater detail subsequently. It is intended that the cross-sectional flow area of the metering passage 81 (see FIG. 4) represents the desired orifice area or flow area for fluid to pass from the reservoir 21 to the external surface 71.

When the metering pin 73 is assembled within the ball plunger 61, the shank portion 77 is inserted within the passage 63, as is generally shown in FIG. 2, but with the head portion 75 resting against the seat 69. In the position described above, most of the lower shank 78 extends below the intersection of the passage 63 and seat 65. While retaining the pin 73 in the position described, an appropriate tool is inserted through the lower end of the upper plunger 17, and engages the bottom end of the lower shank 78, then deforms the lower shank 78 from its original configuration as shown in FIG. 3 to that shown in FIG. 2, such that the lower shank 78 now comprises a stop portion, larger in diameter than the passage 63. Thus, the lower shank or stop 78 limits upward movement of the metering pin 73 to that shown in FIG. 2 whenever there is the normal reservoir pressure of about 15 psi to about 60 psi in the reservoir 21.

The operation of the metering pin 73 will now be described. Whenever there is relatively low, or perhaps even negative pressure in the reservoir 21, the pin 73 will move downward until a surface 83 (see FIG. 3) of the head portion 75 engages the seat 69. In this downward-most position of the metering pin 73, no air can flow past the metering pin into the reservoir 21, such that the pin 73 (and specifically, the head portion 75) serves as a check valve.

During normal operation, with a normal pressure being present in the reservoir 21, the metering pin 73 is biased to its upward-most position shown in FIG. 2. In accordance with one important aspect of the invention, even after the deformation of the lower shank 78 to form the stop, the effective flow area or orifice area through the metering passage 81 remains substantially unchanged. There is preferably a fairly close fit relationship between the passage 63 and the shank portion 77, such that substantially all the flow from the reservoir 21 passes through the metering passage 81, thus providing very accurate and predictable metering flow to the surfaces 71 and S.

It may be seen by viewing FIG. 2 in conjunction with FIG. 3 that, when the pin 73 is metering as described above, the upper end of the metering passage 81 extends above the upper end of the passage 63, thereby exposing it to the radial clearance between the upper bore portion 67 and the head 75.

During operation of the engine, the metering pin 73 moves upward and downward within the passage 63, in response to changes in the pressure in the reservoir 21. Such movement of the pin 73 is believed to be sufficient to achieve a self-cleaning of any dirt or contaminants which may flow into the metering passage 81 and temporarily become lodged therein.

Within the scope of the present invention, the metering passage 81 may be defined by the cylindrical surface of the passage 63, as shown in FIG. 2, although those skilled in the art will recognize that the manufacturing process will be greatly facilitated by providing the passage 81 on the exterior of the pin 73 instead. However, if the passage 81 is defined by the passage 63, the passage 81 would have to extend at least somewhat down along the seat 65, such that flow through the passage 81 would not be blocked by having the pin 73 in its upwardmost position, as shown in FIG. 2.

Figure 5:
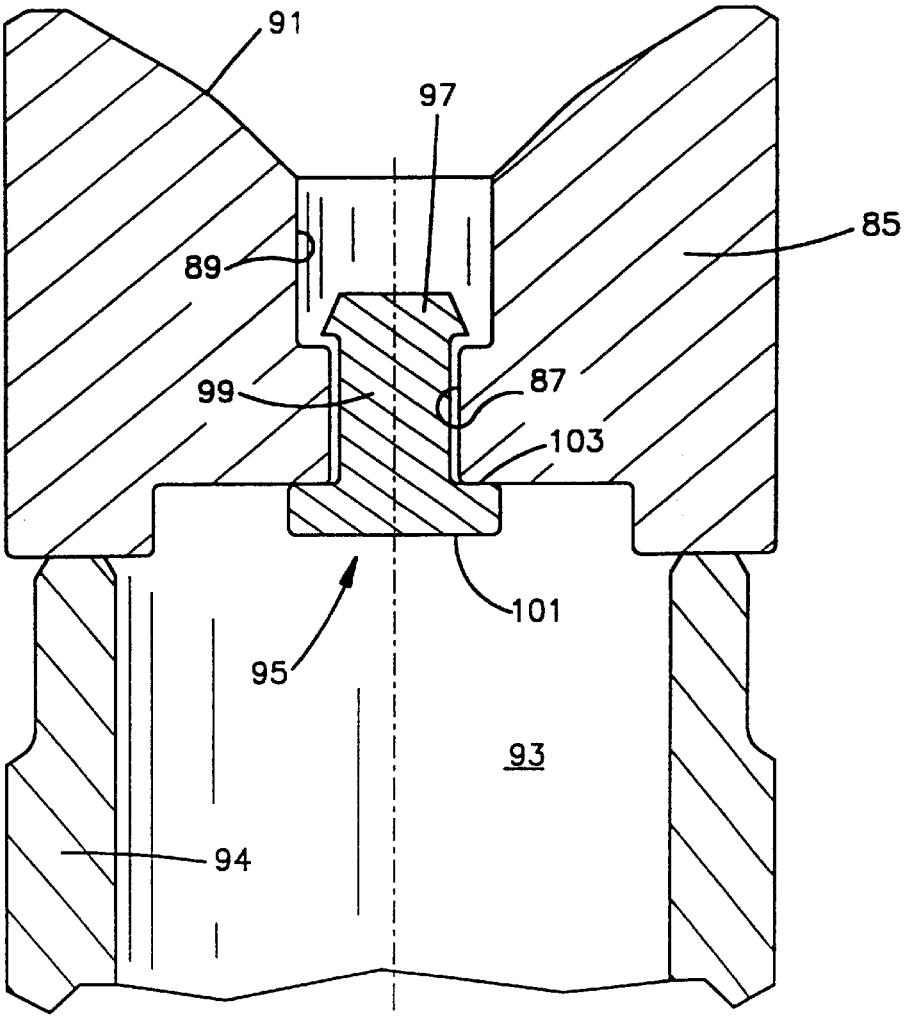
FIG. 5 is a fragmentary, axial cross-section of an alternative embodiment of the present invention.
Figure 6:
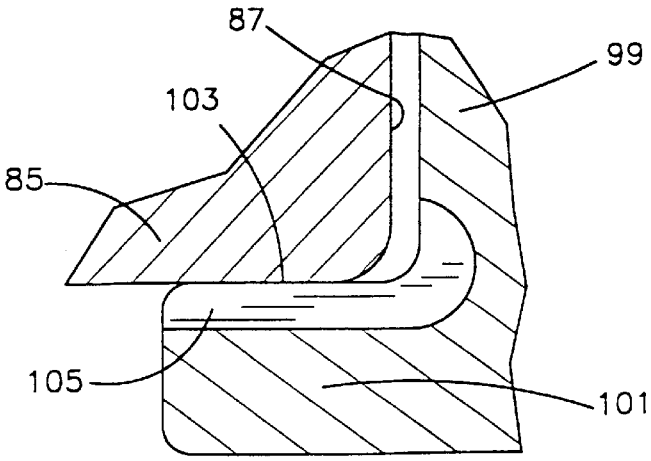
FIG. 6 is an enlarged, fragmentary cross-section of the metering pin shown in the alternative embodiment of FIG. 5, but taken on a different plane.

Referring now primarily to FIGS. 5 and 6, there is illustrated an alternative embodiment of the invention. FIGS. 5 and 6 show fragmentarily the upper portion of a barrel type lifter, including an upper body portion 85. The body 85 defines an axially-extending passage 87, and an upper, enlarged bore portion 89. This type of lifter doesn't include a ball plunger, as in the previous embodiment, but instead, the body 85 includes an upper surface 91, adapted to engage the lower end of a push rod (not shown herein), by way of example only. Disposed beneath the upper body portion 85 is a reservoir 93, one function of which is to provide lubrication fluid to the upper surface 91, and to whatever is engaging the surface 91. The reservoir 93 is surrounded by the upper portion 94 of a plunger assembly, shown only fragmentarily in FIG. 5.

Disposed within the passage 87 is a metering pin, generally designated 95, including a head portion 97, a shank portion 99, and a stop portion 101. One difference between FIGS. 5 and 6 and the previous embodiment is that the metering pin 95 is inserted into the passage 87 by moving it upward in FIG. 5, to the position shown, after which the head portion 97 is deformed as shown in FIG. 5. Thereafter, the head portion 97 serves as the check valve, to prevent air from flowing into the reservoir 93, as in the previous embodiment.

Referring now primarily to FIG. 6, the head portion 101 includes an upper surface 103, seated against the underside of the upper body 85. The upper surface 103 defines a generally radially-extending groove or notch 105 which extends axially a short distance up the shank portion 99. Thus when the reservoir 93 is pressurized, the metering pin is in the position shown in FIGS. 5 and 6, and a small, controlled amount of fluid flows through the groove 105 and then enters the relatively larger radial clearance between the passage 87 and the shank portion 99. In other words, the flow of fluid is controlled by the area of the groove 105, which may be maintained very accurately without excessive manufacturing expense. As in the previous embodiment, when pressure in the reservoir 93 is low, the metering pin 95 will move downward until the head portion 97 seats, thus blocking any flow of air into the reservoir, and any flow of fluid out of the reservoir.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A hydraulic lash adjuster for an internal combustion engine, said lash adjuster comprising a body defining a bore formed therein; a plunger assembly slidingly received within said bore, and cooperating therewith to define a pressure chamber; a fluid chamber disposed within said plunger assembly, and being in communication with a source of fluid; one of said body and said plunger assembly including an external surface adapted for engagement with another member; said one of said body and said plunger assembly defining an axially-extending opening extending from said fluid chamber to said external surface; and a metering pin disposed in said opening, and axially moveable therein; characterized by:

(a) said metering pin and said opening cooperating to define means limiting downward movement of said metering pin toward said fluid chamber, and operable to prevent fluid flow from outside of said lash adjuster, past said metering pin and into said fluid chamber;

(b) said metering pin including a stop portion larger than said axially-extending opening, to limit upward movement of said metering pin in response to pressure in said fluid chamber; and, (c) said axially-extending opening and said metering pin cooperating to define a metering passage having a predetermined metering flow area when said metering pin is in its upwardmost axial position to permit communication of fluid from said fluid chamber to said external surface said metering passage comprising a groove disposed on at least one of the exterior of said metering pin and the surface of said axially extending opening.

2. A hydraulic lash adjuster as claimed in claim 1, characterized by said plunger assembly including a ball plunger portion defining said external surface, and said another member comprises a rocker arm member defining an internal surface in engagement with said external surface.

3. A hydraulic lash adjuster as claimed in claim 1, characterized by said metering pin being generally cylindrical and said metering passage comprising an axially-extending groove disposed on the exterior of said metering pin.

4. A hydraulic lash adjuster as claimed in claim 3, characterized by said stop portion comprising a generally cylindrical portion including an upper surface disposed in engagement with an adjacent internal surface of said plunger assembly when said metering pin is in its upward-most axial position, said upper surface defining a portion of said metering passage.

5. A hydraulic lash adjuster as claimed in claim 1, characterized by said metering pin including a head portion seated against an adjacent surface of said body when said metering pin is in its upward-most axial position, an upper surface of said head portion defining a groove comprising said metering passage.

6. A hydraulic lash adjuster as claimed in claim 5, characterized by said metering pin including a shank portion cooperating with said opening to define a diametral clearance, said groove extending axially upward along said shank portion to be in fluid communication with said diametral clearance.

7. A hydraulic lash adjuster as claimed in claim 1, characterized by said metering passage comprising an axially extending groove disposed on the surface of said axially extending opening.

* * * * *